US011098409B2

(12) United States Patent
Kudo et al.

(10) Patent No.: US 11,098,409 B2
(45) Date of Patent: Aug. 24, 2021

(54) ELECTROLYTIC CELL AND ELECTROLYTIC DEVICE FOR CARBON DIOXIDE

(71) Applicant: Kabushiki Kaisha Toshiba, Minato-ku (JP)

(72) Inventors: Yuki Kudo, Yokohama (JP); Akihiko Ono, Kita (JP); Masakazu Yamagiwa, Yokohama (JP); Ryota Kitagawa, Setagaya (JP); Jun Tamura, Chuo (JP); Yoshitsune Sugano, Kawasaki (JP); Asahi Motoshige, Ota (JP); Satoshi Mikoshiba, Yamato (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 79 days.

(21) Appl. No.: 16/560,082

(22) Filed: Sep. 4, 2019

(65) Prior Publication Data

US 2020/0002824 A1 Jan. 2, 2020

Related U.S. Application Data

(63) Continuation of application No. PCT/JP2018/033311, filed on Sep. 7, 2018.

(30) Foreign Application Priority Data

Mar. 16, 2018 (JP) ..... JP2018049896

(51) Int. Cl.
*C25B 13/04* (2021.01)
*C25B 11/03* (2021.01)
(Continued)

(52) U.S. Cl.
CPC ..... *C25B 11/03* (2013.01); *C25B 1/00* (2013.01); *C25B 3/25* (2021.01); *C25B 9/23* (2021.01)

(58) Field of Classification Search
CPC .. C25B 1/02; C25B 13/04; C25B 1/04; C25B 9/00; C25B 15/08; C25B 1/46; C25B 3/00
See application file for complete search history.

(56) References Cited

U.S. PATENT DOCUMENTS

2013/0186771 A1* 7/2013 Zhai ..... C25B 11/0405 205/440
2013/0240372 A1 9/2013 Bulan et al.
(Continued)

FOREIGN PATENT DOCUMENTS

CA 2 950 294 A1 12/2015
EP 3 149 288 A1 4/2017
(Continued)

OTHER PUBLICATIONS

International Search Report dated Nov. 6, 2018 in PCT/JP2018/033311 filed Sep. 7, 2018 (with English Translation of Categories of Cited Documents).
(Continued)

*Primary Examiner* — Zulmariam Mendez
(74) *Attorney, Agent, or Firm* — Oblon, McClelland, Maier & Neustadt, L.L.P.

(57) ABSTRACT

An electrolytic cell for carbon dioxide of an embodiment includes: an anode part including an anode to oxidize water or a hydroxide ion and thus produce oxygen and an anode solution flow path to supply an anode solution to the anode; a cathode part including a cathode to reduce carbon dioxide and thus produce a carbon compound, a cathode solution flow path to supply a cathode solution to the cathode, and a liquid passing member disposed between the cathode and the cathode solution flow path and having a pore allowing the cathode solution to pass through while holding the
(Continued)

cathode solution; and a separator to separate the anode part and the cathode part from each other.

12 Claims, 10 Drawing Sheets

(51) Int. Cl.

| | |
|---|---|
| ***C25B 1/00*** | (2021.01) |
| ***C25B 3/25*** | (2021.01) |
| ***C25B 9/23*** | (2021.01) |

(56) References Cited

U.S. PATENT DOCUMENTS

| | | | | |
|---|---|---|---|---|
| 2014/0206896 | A1* | 7/2014 | Sivasankar | C07C 51/347 560/204 |
| 2017/0268118 | A1 | 9/2017 | Ono et al. | |
| 2018/0216243 | A1 | 8/2018 | Kudo et al. | |
| 2018/0265440 | A1 | 9/2018 | Kudo et al. | |

FOREIGN PATENT DOCUMENTS

| | | | |
|---|---|---|---|
| JP | 2001-259643 | A | 9/2001 |
| JP | 2012-112001 | A | 6/2012 |
| JP | 2012-150595 | A | 8/2012 |
| JP | 2013-194323 | A | 9/2013 |
| JP | 2014-167146 | A | 9/2014 |
| JP | 2017-521555 | A | 8/2017 |
| JP | 2017-172037 | A | 9/2017 |
| JP | 2018-123390 | A | 8/2018 |
| WO | WO 2016/083193 | A1 | 6/2016 |

OTHER PUBLICATIONS

Written Opinion dated Nov. 6, 2018 in PCT/JP2018/033311 filed Sep. 7, 2018.

Yang, H, et al., "Electrochemical conversion of $CO_2$ to formic acid utilizing Sustainion membranes", Journal of $CO_2$ Utilization, 20, 2017, pp. 208-217.

* cited by examiner

ELECTROLYTIC CELL AND ELECTROLYTIC DEVICE FOR CARBON DIOXIDE

CROSS-REFERENCE TO RELATED APPLICATION

This application is a continuation of prior International Application No. PCT/JP2018/033311, filed on Sep. 7, 2018 which is based upon and claims the benefit of priority from Japanese Patent Application No. 2018-049896, filed on Mar. 16, 2018; the entire contents of all of which are incorporated herein by reference.

FIELD

Embodiments described herein relate generally to an electrolytic cell and an electrolytic device for carbon dioxide.

BACKGROUND

In recent years, there has been a concern about the depletion of fossil fuel such as petroleum and coal, and expectations are increasing for sustainable renewable energy. Examples of the renewable energy include those by a solar battery and wind power generation. The amount of power generated by these depends on weather and nature conditions, and thus they have a problem of difficulty in stably supplying the power. In light of this, it has been attempted to store, in a storage battery, the power generated from the renewable energy, so as to stabilize the power supply. However, when the electric power is stored, there are problems that a cost is required for the storage battery and a loss occurs at a time of storage.

What is gaining attention under such circumstances is a technique which, by using power generated from renewable energy, electrolyzes water to produce hydrogen ($H_2$) from the water, or electrochemically reduces carbon dioxide ($CO_2$) to convert it into a chemical substance (chemical energy) such as a carbon compound such as carbon monoxide (CO), formic acid (HCOOH), methanol ($CH_3OH$), methane ($CH_4$), acetic acid ($CH_3COOH$), ethanol ($C_2H_5OH$), ethane ($C_2H_6$), or ethylene ($C_2H_4$). Storing these chemical substances in a cylinder or a tank has advantages of being lower in energy storage cost and smaller in storage loss than storing the power (electric energy) in the storage battery.

Regarding an electrolytic cell for carbon dioxide, studies have been conducted on a structure including a cathode which is in contact with a cathode solution and a $CO_2$ gas, an anode which is in contact with an anode solution, and a separator which separates the cathode and the anode from each other. The cathode has, for example, a catalyst layer and a gas diffusion layer, with the catalyst layer in contact with the cathode solution and the gas diffusion layer in contact with the $CO_2$ gas. A solution flow path for supplying the cathode solution is disposed, for example, between the separator and the cathode. A gas flow path for supplying the $CO_2$ gas is disposed along a surface of the cathode opposite its surface in contact with the solution flow path. When a constant current is passed across the cathode and the anode to cause the reaction that produces, for example, CO from $CO_2$, using an electrolytic device including such an electrolytic cell, a problem that the $CO_2$ gas passes through the cathode to enter the cathode solution flow path may occur depending on conditions such as the supply amounts and pressures of the cathode solution and the $CO_2$ gas. The entrance of the $CO_2$ gas to the cathode solution flow path increases solution resistance, which may lead to a fluctuation in cell voltage.

Regarding the electrolytic cell for carbon dioxide, studies have been conducted on a structure in which, for example, an anion exchange membrane is disposed in close contact with the cathode. The anion exchange membrane inhibits the $CO_2$ gas from entering the cathode solution flow path. Such a cell structure is suitable for producing a gas component such as CO or ethylene from $CO_2$. Further, this cell structure is also applicable in a case where anions such as formate ions or acetate ions which can pass through the anion exchange membrane are produced. However, when a non-ionic liquid component such as methanol or ethanol is produced, it is difficult to take out the liquid component to the cathode solution flow path through the anion exchange membrane because these liquid components do not easily pass through the ion exchange membrane.

DETAILED DESCRIPTION

An electrolytic cell for carbon dioxide of an embodiment includes: an anode part including an anode to oxidize water or a hydroxide ion and thus produce oxygen and an anode solution flow path to supply an anode solution to the anode; a cathode part including a cathode to reduce carbon dioxide and thus produce a carbon compound, a cathode solution flow path to supply a cathode solution to the cathode, a gas flow path to supply the carbon dioxide to the cathode, and a liquid passing member disposed between the cathode and the cathode solution flow path and having a pore allowing the cathode solution to pass through while holding the cathode solution; and a separator to separate the anode part and the cathode part from each other.

An electrolytic cell and an electrolytic device for carbon dioxide of embodiments will be hereinafter described with reference to the drawings. In the embodiments, substantially the same components are denoted by the same reference signs, and a description thereof may be partly omitted. The drawings are schematic, and a relation between thickness and planar dimension, a thickness ratio among parts, and so on may be different from actual ones.

First Embodiment

Figure 1:
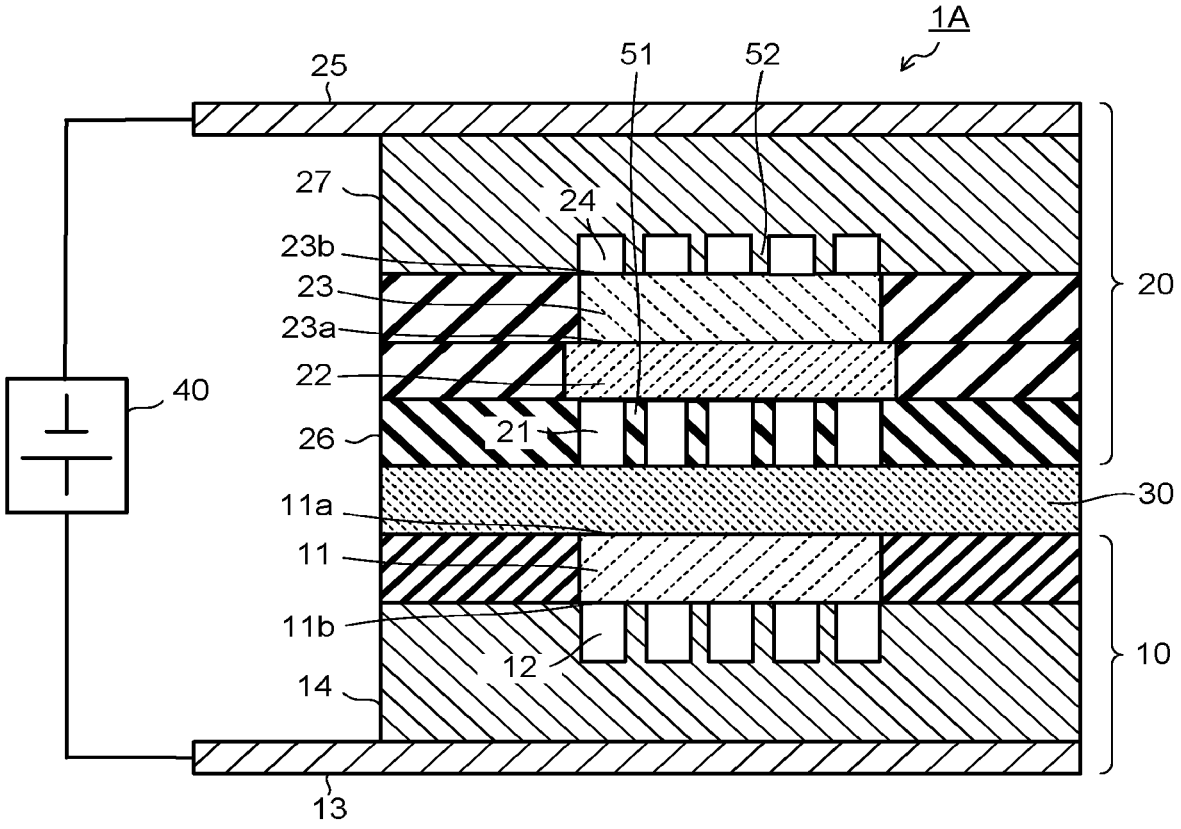
FIG. 1 is a sectional view illustrating an electrolytic cell of a first embodiment.

FIG. 1 is a sectional view illustrating the structure of an electrolytic cell 1 for carbon dioxide according to a first embodiment. The electrolytic cell 1A for carbon dioxide illustrated in FIG. 1 includes an anode part 10, a cathode part 20, and a separator 30. The anode part 10 includes an anode 11, an anode solution flow path 12, and an anode current collector plate 13. The cathode part 20 includes a cathode solution flow path 21, a liquid passing member 22, a cathode 23, a $CO_2$ gas flow path 24, and a cathode current collector plate 25. The separator 30 is disposed so as to separate the anode part 10 and the cathode part 20 from each other. The electrolytic cell 1A is sandwiched by a not-illustrated pair of support plates and is further fastened with bolts or the like. In FIG. 1, reference sign 40 denotes a power source which passes a current to the anode 11 and the cathode 22. The electrolytic cell 1A and the power source 40 constitute an electrolytic device for carbon dioxide of the embodiment. The power source 40 is not limited to an ordinary commercial power source, battery, or the like, and may be a power supply source that supplies power generated from renewable energy by a solar battery, wind power generation, or the like.

The anode 11 is an electrode (oxidation electrode) which causes an oxidation reaction of water ($H_2O$) present in an anode solution to produce oxygen ($O_2$) and hydrogen ions ($H^+$), or causes an oxidation reaction of hydroxide ions ($OH^-$) produced in the cathode part 20 to produce oxygen ($O_2$) and water ($H_2O$). The anode 11 has a first surface 11*a* in contact with the separator 30 and a second surface 11*b* facing the anode solution flow path 12. The first surface 11*a* of the anode 11 is in close contact with the separator 30. The anode solution flow path 12 supplies the anode solution to the anode 11 and is constituted by pits (grooves/depressions) provided in a first flow path plate 14. A solution inlet port and a solution outlet port, which are not illustrated, connect with the first flow path plate 14, and the anode solution is introduced and discharged by a not-illustrated pump through these solution inlet port and solution outlet port. The anode solution flows in the anode solution flow path 12 to come into contact with the anode 11. The anode current collector plate 13 is in electrical contact with a surface of the first flow path plate 14 constituting the anode solution flow path 12, opposite the anode 11.

The anode 11 is preferably formed mainly of a catalyst material (anode catalyst material) that is capable of producing oxygen and hydrogen ions by oxidizing water ($H_2O$) or of producing water and oxygen by oxidizing hydroxide ions ($OH^-$) and that is capable of decreasing overvoltages of such reactions. Examples of such a catalyst material include metals such as platinum (Pt), palladium (Pd), and nickel (Ni), alloys and intermetallic compounds containing any of these metals, binary metal oxides such as manganese oxide (Mn—O), iridium oxide (Ir—O), nickel oxide (Ni—O), cobalt oxide (Co—O), iron oxide (Fe—O), tin oxide (Sn—O), indium oxide (In—O), ruthenium oxide (Ru—O), lithium oxide (Li—O), and lanthanum oxide (La—O), ternary metal oxides such as Ni—Co—O, Ni—Fe—O, La—Co—O, Ni—La—O, and Sr—Fe—O, quaternary metal oxides such as Pb—Ru—Ir—O and La—Sr—Co—O, and metal complexes such as a Ru complex and a Fe complex.

The anode 11 includes a base material having a structure allowing the anode solution and ions to move between the separator 30 and the anode solution flow path 12, for example, having a porous structure such as a mesh material, a punched material, a porous body, or a metal fiber sintered compact. The base material may be formed of a metal material of a metal such as titanium (Ti), nickel (Ni), or iron (Fe) or an alloy (for example, SUS) containing at least one of these metals, may be formed of a carbon material, or may be formed of the aforesaid anode catalyst material. Where the oxide is used as the anode catalyst material, it is preferable to form a catalyst layer by sticking or stacking the anode catalyst material on a surface of the base material formed of the aforesaid metal material or carbon material. The anode catalyst material preferably has nanoparticles, a nanostructure, a nanowire, or the like in order to promote the oxidation reaction. The nanostructure is a structure in which nanoscale irregularities are formed on a surface of the catalyst material.

The cathode 23 is an electrode (reduction electrode) which causes a reduction reaction of carbon dioxide ($CO_2$) or a reduction reaction of a carbon compound produced by the carbon dioxide reduction reaction to produce a carbon compound such as carbon monoxide (CO), methane ($CH_4$), ethane ($C_2H_6$), ethylene ($C_2H_4$), methanol ($CH_3OH$), ethanol ($C_2H_5OH$), or ethylene glycol ($C_2H_6O_2$). The cathode 23 has a first surface 23*a* in contact with the liquid passing member 22 and a second surface 23*b* facing the $CO_2$ gas flow path 24. The cathode solution flow path 21 is disposed between the liquid passing member 22 and the separator 30 so that a cathode solution comes into contact with the cathode 23 through the liquid passing member 22 and comes into contact with the separator 30. The liquid passing member 22 is disposed between the cathode solution flow path 21 and the cathode 23. The $CO_2$ gas flow path 24 faces a surface of the cathode 23 opposite its surface in contact with the liquid passing member 22 so that a $CO_2$ gas comes into contact with the cathode 23.

The cathode solution flow path 21 is constituted by openings provided in a second flow path plate 26. A solution inlet port and a solution outlet port, which are not illustrated, connect with the second flow path plate 26, and the cathode solution is introduced and discharged by a not-illustrated pump through these solution inlet port and solution outlet port. The cathode solution flows in the cathode solution flow path 21 to come into contact with the cathode 23 through the liquid passing member 22 and come into contact with the separator 30. As illustrated in FIG. 1, a plurality of lands (projections) 51 may be provided in the cathode solution flow path 21 to adjust the length, a route, and so on of the cathode solution flow path 21. In this case, it is preferable to alternately provide the plurality of lands 51 so that the cathode solution flow path 21 meanders. The lands 51 may be provided near the center of the cathode solution flow path 21 for the purpose of mechanical support and electrical conduction. In this case, the lands 51 are preferably held in the second flow path plate 26 by bridge portions (not illustrated) thinner than the lands 51 so as not to prevent the flow of the cathode solution in the cathode solution flow path 21.

The $CO_2$ gas flow path 24 is constituted by pits (grooves/depressions) provided in a third flow path plate 27. A gas inlet port and a gas outlet port, which are not illustrated, connect with the third flow path plate 27, and a gas containing $CO_2$ (sometimes simply called $CO_2$ gas) is introduced and discharged through these gas inlet port and gas outlet port by a not-illustrated flow rate controller. The gas containing $CO_2$ flows in the $CO_2$ gas flow path 24 to come into contact with the cathode 23. The cathode current collector plate 25 is in electrical contact with a surface of the third flow path plate 27 opposite the cathode 23. In the $CO_2$ gas flow path 24, lands (projections) 52 may be provided as illustrated in FIG. 1 to adjust the length, a route, and so on of the $CO_2$ gas flow path 24. In this case, the lands 52 may be disposed such that their longitudinal direction is perpendicular or parallel to the longitudinal direction of the lands 51 in the cathode solution flow path 21. To reduce cell resistance, the smaller the number of the lands 52 in the $CO_2$ gas flow path 24, the more preferable.

Figure 2:
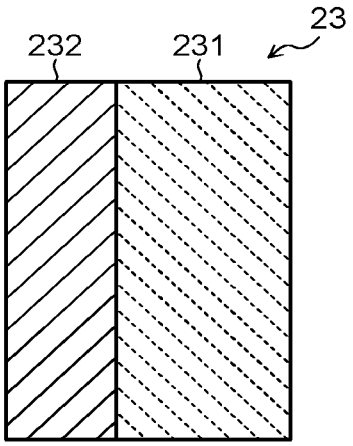
FIG. 2 is a view illustrating an example of a cathode in the electrolytic cell of the embodiment.
Figure 3:
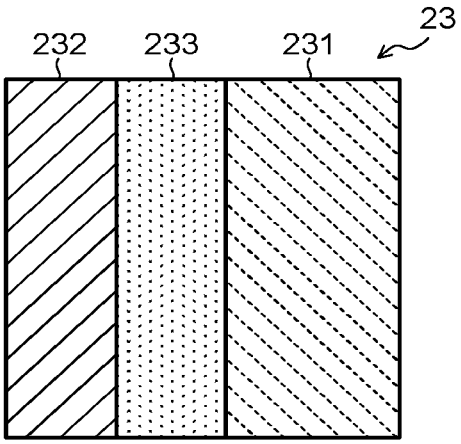
FIG. 3 is a view illustrating another example of the cathode in the electrolytic cell of the embodiment.

As illustrated in FIG. 2, the cathode 23 has a gas diffusion layer 231 and a cathode catalyst layer 232 provided thereon. As illustrated in FIG. 3, between the gas diffusion layer 231 and the cathode catalyst layer 232, a porous layer 233 denser than the gas diffusion layer 231 may be disposed. The gas diffusion layer 231 is disposed on the $CO_2$ gas flow path 24 side, and the cathode catalyst layer 232 is disposed on the cathode solution flow path 21 side. The cathode catalyst layer 232 preferably has catalyst nanoparticles or a catalyst nanostructure. Between the cathode solution flow path 21 and the cathode catalyst layer 232, the liquid passing member 22 is disposed. That is, the liquid passing member 22 is disposed so that the cathode solution flowing in the cathode solution flow path 21 comes into contact with the cathode catalyst layer 232 through the liquid passing member 22. The liquid passing member 22 inhibits the $CO_2$ gas from entering the inside of the cathode solution flow path 21 without preventing the cathode solution from coming into contact with the cathode catalyst layer 232 and also makes it possible to take out a liquid product to the cathode solution flow path 21, as will be described later.

The gas diffusion layer 231 is formed of a material having electrical conductivity, for example, carbon paper, carbon cloth, or the like so as to pass a current from the cathode current collector plate 25 to the cathode 22. Further, in order to keep the supply balance of the cathode solution and the $CO_2$ gas near a catalyst of the cathode catalyst layer 232, treatment for imparting appropriate hydrophobicity is preferably applied to the carbon paper, the carbon cloth, or the like which is the gas diffusion layer 231. Hydrophobicity is a property of low affinity with water. Examples of a material exhibiting hydrophobicity include fluororesins such as polytetrafluoroethylene (PTFE), polychlorotrifluoroethylene, polyvinylidene fluoride, polyvinyl fluoride, and a perfluoroalkoxy fluororesin. The carbon paper, the carbon cloth, or the like containing such a fluororesin makes it possible for the gas diffusion layer 231 to have the appropriate hydrophobicity while maintaining the conductivity. The porous layer 233 is preferably formed of a porous body smaller in pore size than the carbon paper or the carbon cloth.

As described above, the gas diffusion layer 231 preferably has a composite in which the conductive porous body such as the carbon paper or the carbon cloth is appropriately impregnated with the material exhibiting hydrophobicity (hydrophobic resin or the like) such as the fluororesin. The content of the fluororesin in the gas diffusion layer 231 is preferably within a range of 5 to 10 mass %. The content (mass %) of the fluororesin mentioned here is a mass ratio of the fluororesin to the total amount of the gas diffusion layer 231. If the content of the fluororesin in the gas diffusion layer 231 is over 10 mass %, the cathode solution does not sufficiently permeate the gas diffusion layer 231, which may lead to low efficiency of the contact between the cathode solution and the $CO_2$ gas. If the content of the fluororesin in the gas diffusion layer 231 is less than 5 mass %, the cathode solution may excessively permeate the gas diffusion layer 231. In either case, the supply balance of the cathode solution and the $CO_2$ gas near the catalyst is likely to worsen, and it is not possible to sufficiently increase the reactivity of the cathode solution and the $CO_2$ gas.

Figure 4:
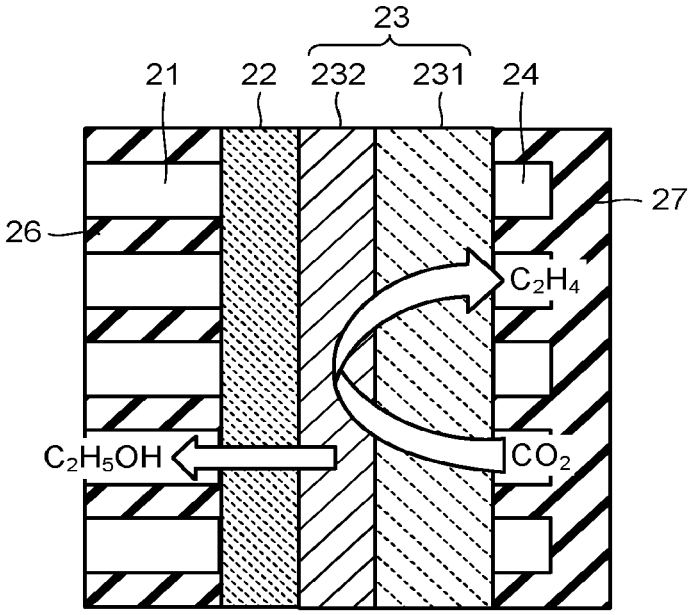
FIG. 4 is a view illustrating a $CO_2$ gas flow path, the cathode, a liquid passing member, and a cathode solution flow path in the electrolytic cell of the first embodiment.

As illustrated in FIG. 4, in the cathode catalyst layer 232, the cathode solution and ions are supplied and discharged from/to the cathode solution flow path 21 through the liquid passing member 22, and in the gas diffusion layer 231, the $CO_2$ gas is supplied and a product of the reduction reaction of the $CO_2$ gas is discharged from/to the $CO_2$ gas flow path 24. Owing to the appropriate hydrophobic treatment applied to the gas diffusion layer 231, mainly the $CO_2$ gas reaches the cathode catalyst layer 232 due to gas diffusion. The reduction reaction of $CO_2$ takes place mainly near the boundary between the gas diffusion layer 231 and the cathode catalyst layer 232, and a gaseous product is discharged mainly from the $CO_2$ gas flow path 24, and a liquid product is discharged mainly from the cathode solution flow path 21 through the liquid passing member 22. For the efficient $CO_2$ reduction reaction, the $CO_2$ gas, and the ions and $H_2O$ necessary for the reaction are preferably supplied and discharged to/from the cathode catalyst layer 232 in a well-balanced manner.

The cathode catalyst layer 232 is preferably formed of a catalyst material (cathode catalyst material) that is capable of producing a carbon compound by reducing carbon dioxide, and as required, producing a carbon compound by reducing the carbon compound produced by the carbon dioxide reduction, and is also capable of decreasing overvoltages of such reactions. Examples of such a material include metal materials of metals such as gold (Au), silver (Ag), copper (Cu), platinum (Pt), palladium (Pd), nickel (Ni), cobalt (Co), iron (Fe), manganese (Mn), titanium (Ti), cadmium (Cd), zinc (Zn), indium (In), gallium (Ga), lead (Pb), and tin (Sn), and of alloys and intermetallic compounds including at least one of these metals, carbon materials such as carbon (C), graphene, CNT (carbon nanotube), fullerene, and ketjen black, and metal complexes such as a Ru complex and a Re complex. The cathode catalyst layer 232 may have any of various shapes such as a plate shape, a mesh shape, a wire shape, a granular shape, a porous shape, a thin film shape, and an island shape.

The cathode catalyst material forming the cathode catalyst layer 232 preferably has nanoparticles of the aforesaid metal material, a nanostructure of the metal material, a nanowire of the metal material, or a composite in which the nanoparticles of the aforesaid metal material are carried by the carbon material such as carbon particles, carbon nanotube, or graphene particles. By employing the catalyst nanoparticles, the catalyst nanostructure, the catalyst nanowire, the nano-catalyst carried structure, or the like as the cathode catalyst material, it is possible to increase the reaction efficiency of the reduction reaction of carbon dioxide in the cathode 23.

As illustrated in FIG. 1 and FIG. 4, the liquid passing member 22 is disposed between the cathode catalyst layer 232 of the cathode 23 and the cathode solution flow path 21, and has a function of not only allowing the cathode solution and the ions supplied from the cathode solution flow path 21 to pass through but also blocking the passage of the $CO_2$ gas slightly leaking out from the cathode 23 to prevent the gas from mixing into the cathode solution flow path 21. Further, the liquid passing member 22 allows the liquid product (liquid component) such as methanol, ethanol, formic acid, or acetic acid produced in the cathode 23 to pass to the cathode solution flow path 21 to be taken out in the cathode solution flow path 21. Inhibiting the passage of the gas component by the liquid passing member 22 makes it possible to reduce a solution resistance increase ascribable to the mixture of the gas component into the cathode solution flow path 21 and reduce a cell voltage fluctuation caused by the solution resistance increase.

The liquid passing member 22 preferably has hydrophilicity in order to allow the passage of the liquid component. Hydrophilicity is a function exhibiting a high affinity with water. Further, the liquid passing member 22 preferably has properties that enable the liquid passing member 22 to hold the liquid component therein and that enable the liquid passing member 22 to be filled with the liquid component. In light of this, it is preferable that the liquid passing member 22 has pores allowing the passage of the liquid component such as the cathode solution and holding the liquid component, and a material forming the pores has hydrophilicity. By disposing such a liquid passing member 22 between the cathode catalyst layer 232 and the cathode solution flow path 21 and filling the cathode solution in the pores of the liquid passing member 22 at the time of the operation of the electrolytic cell 1A, it is possible to inhibit the passage of the gas component from the cathode 23 to the cathode solution flow path 21, and in addition, it is possible to pass the liquid component such as the cathode solution and the liquid product between the cathode solution flow path 21 and the cathode 23 through the liquid passing member 22.

Examples of the aforesaid liquid passing member 22 include a woven fabric, a nonwoven fabric, and a porous body that has pores allowing the passage of the liquid component and that is formed of a hydrophilic material or a material having undergone a hydrophilic treatment. The form of the member having the pores is not limited to the woven fabric, the nonwoven fabric, and the porous body and may be a form other than these. Specific examples of the material of the liquid passing member 22 include a woven fabric and a nonwoven fabric of a zirconia fiber having hydrophilicity, a woven fabric and a nonwoven fabric of a fluororesin having undergone the hydrophilic treatment, insulators such as a porous body of a fluororesin having undergone the hydrophilic treatment, conductors such as carbon paper and carbon cloth. The liquid passing member 22 may be either an insulator or a conductor. Examples of the fluororesin include polytetrafluoroethylene (PTFE), polychlorotrifluoroethylene, polyvinylidene fluoride, polyvinyl fluoride, and a perfluoroalkoxy fluororesin. Instead of the woven fabric or the nonwoven fabric of the zirconia fiber, a woven fabric or a nonwoven fabric of an oxide fiber having hydrophilicity may be used. The carbon paper or the carbon cloth may be subjected to the hydrophilic treatment as required.

In order to allow the passage of the liquid component, the liquid passing member 22 preferably has a porosity of 40% or more, more preferably has a porosity of 60% or more, and still more preferably has a porosity of 80% or more. Too low a porosity of the liquid passing member 22 results in the degradation in passability of the liquid component. However, too high a porosity of the liquid passing member may impair the property of blocking the gas component, and therefore the porosity of the liquid passing member 22 is preferably 90% or less. The area of the liquid passing member 22 may be equal to the area of the cathode 23, but in order to increase the property of blocking the gas component, its area is preferably larger than the area of the cathode 23. Specifically, a ratio (A/B) of the area A of the liquid passing member 22 to the area B of the cathode 23 is preferably 1.2 or more.

The separator 30 is formed of an ion exchange membrane or the like that allows ions to move between the anode 11 and the cathode 22 and also that can separate the anode part 10 and the cathode part 20 from each other. Here, if the product by the $CO_2$ reduction reaction in the cathode 23, such as ethanol or methanol, reaches the anode 11, it is converted into $CO_2$ by a reverse reaction, leading to low conversion efficiency. The ion exchange membrane forming the separator 30 has a function of restricting the movement of the alcohol component or the like to the anode 11. Examples usable as the ion exchange membrane include cation exchange membranes such as Nafion and Flemion and anion exchange membranes such as Neosepta and Selemion. However, besides the ion exchange membrane, a glass filter, a porous polymer membrane, a porous insulating material, or the like may be used as the separator 30, provided that the material allows the ions to move between the anode 11 and the cathode 23.

When a solution containing halide ions such as chloride ions ($Cl^-$) by KCl or the like is used as the cathode solution as will be described later, a toxic chlorine gas ($Cl_2$) may be produced when $Cl^-$ reaches the vicinity of the anode. Further, when a hydrogen carbonate ion ($HCO_3^-$)— or carbonate ion ($CO_3^{2-}$)-containing solution such as a $KHCO_3$ solution or a $K_2CO_3$ solution is used as the cathode solution, $CO_2$ may be produced when $HCO_3^-$ or $CO_3^{2-}$ reaches the vicinity of the anode 11. In order for the anode part 10 to output a high-purity $O_2$ gas, the separator 30 is preferably formed of an ion exchange membrane, in particular, formed of a cation exchange membrane having cation permeability to inhibit the movement of the halide ions such as $Cl^-$ and the anions such as $HCO_3^-$ or $CO_3^{2-}$ to the anode 11.

The anode solution and the cathode solution each preferably are a solution containing at least water ($H_2O$). Since carbon dioxide ($CO_2$) is supplied from the $CO_2$ gas flow path 24, the cathode solution may be either a solution containing carbon dioxide ($CO_2$) or a solution not containing carbon dioxide ($CO_2$). The same solution may be used as the anode solution and the cathode solution, or different solutions may be used as these. Examples of the $H_2O$-containing solution used as the anode solution and the cathode solution include an aqueous solution containing an optional electrolyte. Examples of the electrolyte-containing aqueous solution include an aqueous solution containing at least one kind of ions selected from hydroxide ions ($OH^-$), hydrogen ions ($H^+$), potassium ions ($K^+$), sodium ions ($Na^+$), lithium ions ($Li^+$), cesium ions ($Cs^+$), chloride ions ($Cl^-$), bromide ions ($Br^-$), iodide ions (I), nitrate ions ($NO_3^-$), sulfate ions ($SO_4^{2-}$), phosphate ions ($PO_4^{2-}$), borate ions ($BO_3^{3-}$), hydrogen carbonate ions ($HCO_3^-$), and carbonate ions ($CO_3^{2-}$).

In order to reduce the electrical resistance of the solution, an alkali solution in which an electrolyte such as potassium hydroxide or sodium hydroxide is dissolved with a high concentration is preferably used as the anode solution and the cathode solution. Further, in order to enhance the production efficiency of ethanol, ethylene, or the like as the carbon compound produced by the $CO_2$ reduction reaction, an alkaline solution in which an electrolyte such as potassium chloride or sodium chloride is dissolved is preferably used as the cathode solution. Further, in order for the anode part 10 to output the high-purity $O_2$ gas, it is preferable that the anode solution does not contain halide ions such as $Cl^-$, $HCO_3^-$, or $CO_3^{2-}$. As previously described, the use of the cation exchange membrane as the ion exchange membrane constituting the separator 30 makes it possible to inhibit the movement of the anions to the anode 11, and therefore a solution containing halide ions, $HCO_3^-$, or $CO_3^{2-}$ may be used as the cathode solution.

As the cathode solution, an ionic liquid that is made from salt of cations such as imidazolium ions or pyridinium ions and anions such as $BF_4^-$ or $PF_6^-$ and is in a liquid state in a wide temperature range may be used, or its aqueous solution may be used. Other examples of the cathode solution include solutions of amines such as ethanolamine, imidazole, and pyridine and their aqueous solutions. The amine may be any of primary amine, secondary amine, and tertiary amine.

As the first flow path plate 14 forming the anode solution flow path 12 and the third flow path plate 27 forming the $CO_2$ gas flow path, a material low in chemical reactivity and high in conductivity is preferably used. Examples of such a material include metal materials such as Ti and SUS, and carbon. As the second flow path plate 26 forming the cathode solution flow path 21, a material low in chemical reactivity and having no conductivity is preferably used. Examples of such a material include insulating resin materials such as an acrylic resin, polyetheretherketone (PEEK), and a fluororesin.

Incidentally, in the first flow path plate 14, the second flow path plate 26, and the third flow path plate 27, the solution or gas inlet ports and outlet ports, screw holes used when a stack of the constituent elements is fastened, and so on are provided, though not illustrated. Further, in front of and behind each of the flow path plates 14, 26, 27, not-illustrated packings are inserted as required.

Next, the operation of an electrolytic device using the electrolytic cell 1A for carbon dioxide of the embodiment will be described. Here, a case where ethylene ($C_2H_4$) and ethanol ($C_2H_5OH$) are mainly produced as carbon compounds will be mainly described, but the carbon compound as the reduction product of carbon dioxide is not limited to ethylene and ethanol. The carbon compound may be carbon monoxide (CO), methane ($CH_4$), ethane ($C_2H_6$), methanol ($CH_3OH$), ethylene glycol ($C_2H_6O_2$), formic acid (HCOOH), acetic acid ($CH_3COOH$), or the like as previously described. Further, a reaction process by the electrolytic cell 1A can be to produce mainly hydrogen ions ($H^+$) or to produce mainly hydroxide ions ($OH^-$), but is not limited to either of these reaction processes.

First, the reaction process of producing mainly an oxygen gas ($O_2$) from water ($H_2O$) in the anode 11 will be described. When a current is supplied across the anode 11 and the cathode 23 from the power source 40, an oxidation reaction of water ($H_2O$) takes place in the anode 11 in contact with the anode solution. Specifically, as expressed by the following formula (1), through the oxidation of $H_2O$ contained in the anode solution, oxygen ($O_2$) and hydrogen ions ($H^+$) are produced.

$$2H_2O \rightarrow 4H^+ + O_2 + 4e^- \quad (1)$$

$H^+$ produced in the anode 11 moves in the anode solution present in the anode 11 and the separator 30 to reach the inside of the cathode solution flow path 21.

In the cathode 11, by electrons ($e^-$) based on the current supplied from the power source 40 to the cathode 11, the reduction reaction of carbon dioxide ($CO_2$) is caused. Specifically, as expressed by the following formulas (2), (3), through the reduction of $CO_2$ supplied from the $CO_2$ gas flow path 24 to the cathode 23, $C_2H_4$ and $C_2H_5OH$ are produced.

$$2CO_2 + 8H_2O + 12e^- \rightarrow C_2H_4 + 12OH^- \quad (2)$$

$$2CO_2 + 9H_2O + 12e^- \rightarrow C_2H_5OH + 12OH^- \quad (3)$$

$CO_2$ supplied to the cathode 23 is partly absorbed also in the cathode solution present near the cathode 23, and as expressed by the formula (4) and the formula (5), $HCO_3^-$ and $CO_3^{2-}$ are produced.

$$CO_2 + OH^- \rightarrow HCO_3^- \quad (4)$$

$$HCO_3^- + OH^- \rightarrow CO_3^{2-} + H_2O \quad (5)$$

$C_2H_5OH$, $OH^-$, $HCO_3^-$, and $CO_3^{2-}$ thus produced in the cathode 23 can move to the cathode solution flow path 21 through the liquid passing member 22.

In a conventional cell structure where the cathode solution flow path 21 directly faces the cathode 23 (for example, the cathode catalyst layer 232), the $CO_2$ gas and the produced gases sometimes enter the cathode solution flow path 21 through the cathode catalyst layer 232. The entrance of the gas component reduces the volume of the liquid component present in the cathode solution flow path 21 to increase the solution resistance, accordingly increasing the cell voltage when the constant current is passed. Then, when the gas entering the inside of the cathode solution flow path 21 is discharged by the flow of the cathode solution, the cell voltage reduces. Such entrance and discharge of the gas cause a fluctuation in the cell voltage to cause a problem of the unstable cell operation. In contrast, in the electrolytic cell 1A of the embodiment, since the liquid passing member 22 having the aforesaid function is disposed between the cathode 23 and the cathode solution flow path 21, it is possible to reduce the entrance of the gas component to the cathode solution flow path 21 to reduce the fluctuation in the cell voltage. Therefore, it is possible to enhance the property of the electrolytic cell 1A and its sustainability.

Second Embodiment

Next, an electrolytic cell 1 for carbon dioxide according to a second embodiment will be described with reference to FIG. 5. The electrolytic cell 1B for carbon dioxide illustrated in FIG. 5 includes an anode part 10, a cathode part 20, and a separator 30 as in the first embodiment. The structures of the anode part 10 and the separator 30 are the same as those of the first embodiment, and the cathode part 20 has a different structure from that of the first embodiment. The electrolytic cell 1B is sandwiched by a not-illustrated pair of support plates and is further fastened with bolts or the like as in the first embodiment. In the electrolytic cell 1B illustrated in FIG. 5, a current is supplied to the anode 11 and the cathode 22 from a power source 40 through the anode current collector plate 13 and the cathode current collector plate 25 as in the first embodiment. The electrolytic cell 1B and the power source 40 constitute an electrolytic device for carbon dioxide according to the second embodiment.

Figure 5:
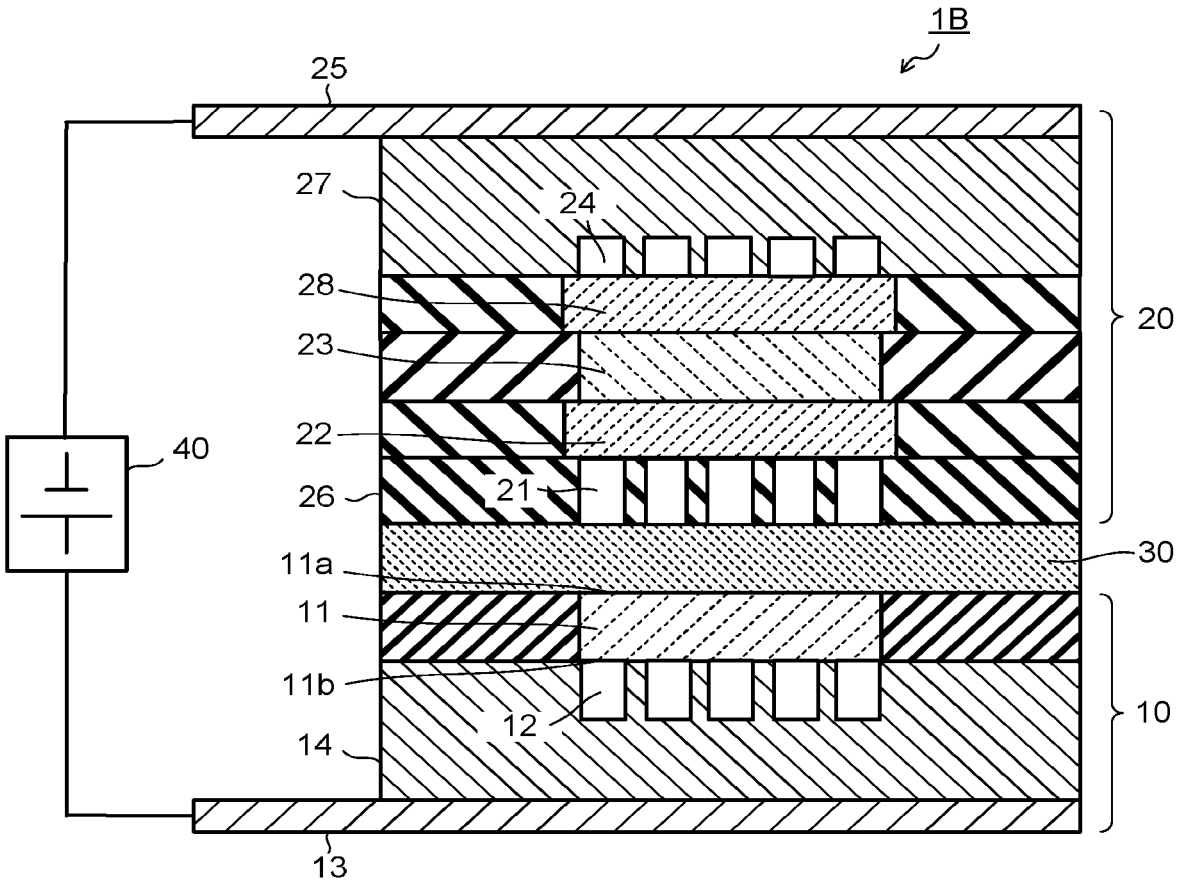
FIG. 5 is a sectional view illustrating an electrolytic cell of a second embodiment.

In the electrolytic cell 1B illustrated in FIG. 5, the cathode part 20 includes a hydrophobic porous body 28 disposed between the $CO_2$ gas flow path 24 (the third flow path plate 27 forming this) and the cathode 23, in addition to the cathode solution flow path 21, the liquid passing member 22, the cathode 23, the $CO_2$ gas flow path 24, and the cathode current collector plate 25, which is a different point from the electrolytic cell 1A of the first embodiment. The hydrophobic porous body 28 not only allows the $CO_2$ gas supplied from the $CO_2$ gas flow path 24 to pass toward the cathode 23 (the gas diffusion layer 231) but also blocks the cathode solution which has permeated the cathode 23 from the cathode solution flow path 21 to prevent the cathode solution from flowing into the $CO_2$ gas flow path 24. The prevention of the cathode solution from flowing into the $CO_2$ gas flow path 24 makes it possible to reduce a pressure increase in the $CO_2$ gas flow path 24. This keeps the supply balance of the cathode solution and the $CO_2$ gas near the catalyst, thereby capable of reducing the cell voltage fluctuation and so on. Further, since the precipitation of the electrolyte present in the cathode solution into the $CO_2$ gas flow path 24 can be prevented, the clogging of the $CO_2$ gas flow path 24 due to the precipitation of the electrolyte is inhibited. This enables to enhance the property of the electrolytic cell 1A and its sustainability In the electrolytic cell 1B having the structure illustrated in FIG. 5, since the current is passed to the cathode 23 from the cathode current collector plate 25 through the hydrophobic porous body 28, the hydrophobic porous body 28 preferably has appropriate conductivity in addition to the hydrophobicity for blocking the cathode solution. Examples of the hydrophobic porous body 28 having such properties include a composite in which a porous material having conductivity, such as carbon paper or carbon cloth, is sufficiently impregnated with a hydrophobic material within a range not impairing the conductivity. Examples of a material imparting the hydrophobicity to the conductive porous material such as the carbon paper or the carbon cloth include the aforesaid fluororesins such as polytetrafluoroethylene (PTFE), polychlorotrifluoroethylene, polyvinylidene fluoride, polyvinyl fluoride, and a perfluoroalkoxy fluororesin.

Requiring no consideration of the gas-liquid balance near the catalyst unlike the aforesaid gas diffusion layer 231, the hydrophobic porous body 28 is preferably impregnated with the hydrophobic material sufficiently within a range not impairing the conductivity. Specifically, the content of the fluororesin in the hydrophobic porous body 28 is preferably 50 mass % or more. However, too large a content of the fluororesin may impair the conductivity of the hydrophobic porous body 28, and accordingly the content of the fluororesin is preferably 90 mass % or less, and more preferably 70 mass % or less.

Further, the hydrophobic porous body 28 preferably has appropriate pores in order to allow the $CO_2$ gas supplied from the $CO_2$ gas flow path 24 to pass toward the gas diffusion layer 231. The porosity of the hydrophobic porous body 28 is preferably 40% or more, more preferably 60% or more, and still more preferably 80% or more. However, too high a porosity of the hydrophobic porous body 28 may impair the property of blocking the cathode solution, and therefore the porosity is preferably 90% or less. The area of the hydrophobic porous body 28 may be equal to the area of the cathode 23, but in order to increase the property of preventing the permeation of the cathode solution, the area of the hydrophobic porous body 28 is preferably larger than the area of the cathode 23. A ratio (CB) of the area C of the hydrophobic porous body 28 to the area B of the cathode 23 is preferably 1.2 or more.

Third Embodiment

Next, an electrolytic cell 1 for carbon dioxide according to a third embodiment will be described with reference to FIG. 6. The electrolytic cell 1C for carbon dioxide illustrated in FIG. 6 includes an anode part 10, a cathode part 20, and a separator 30 as in the second embodiment. The structures of the anode part 10, the cathode part 20, the separator 30, and so on and the structure of an electrolytic device using the electrolytic cell 1C are the same as those in the second embodiment. In the electrolytic cell 1C illustrated in FIG. 6, the cathode current collector plate 25 is disposed between the cathode 23 and the liquid passing member 22, which is a different point from the electrolytic cell 1B of the second embodiment.

The cathode current collector plate 25 is in contact with the cathode 23 (for example, the cathode catalyst layer 232), so that they are in electrical continuity. In order for the cathode current collector plate 25 disposed between the liquid passing member 22 and the cathode 23 not to prevent the cathode solution flowing in the cathode solution flow path 21 from coming into contact with the cathode 23, openings 25*a* with an open area ratio of 40% or more are provided in the cathode collector plate 25. The cathode solution flowing in the cathode solution flow path 21 is capable of coming into contact with the cathode 23 through the openings 25*a*. The openings 25*a* of the cathode current collector plate 25 are preferably aligned with the openings (openings 26*a* provided in the second flow path plate 26) constituting the cathode solution flow path 21. As the cathode current collector plate 25, a material low in chemical reactivity and high in conductivity is preferably used. Examples of such a material include metal materials such as Ti and SUS, and carbon.

Disposing the cathode current collector plate 25 between the cathode 23 and the liquid passing member 22 enables the use of an insulator as the hydrophobic porous body 28. Here, the hydrophobic porous body 28 preferably has a large content of the fluororesin in order to have an enhanced hydrophobic function. However, as the content of the fluororesin increases, electrical conductivity is degraded. In the electrolytic cell 1B of the second embodiment, the degradation in the electrical conductivity of the hydrophobic porous body 28 increases an IR loss due to the resistance of the hydrophobic porous body 28, which may lower $CO_2$ reduction efficiency. In contrast, in the electrolytic cell 1C of the third embodiment, since the hydrophobic porous body 28 can be formed of the insulator, it is possible to inhibit the lowering of the $CO_2$ reduction efficiency while enhancing the hydrophobic function of the hydrophobic porous body 28.

That is, in the electrolytic cell 1C of the third embodiment, it is possible to increase the content of the fluororesin in the hydrophobic porous body 28, and further set the content of the fluororesin in the hydrophobic porous body 28 to substantially 100 mass %. In the electrolytic cell 1C of the third embodiment, the content of the fluororesin in the hydrophobic porous body 28 is preferably 50 mass % or more, more preferably 70 mass % or more, and still more preferably substantially 100 mass %. Examples of a porous material having the fluororesin as the whole hydrophobic porous body 28 include a membrane filter and a sheet of hydrophobic PTFE. The use of such a hydrophobic porous body 28 enables the more effective prevention of the mixture of the cathode solution into the $CO_2$ gas flow path 24 to enhance the property of the electrolytic cell 1C and its sustainability.

In the electrolytic cell 1C of the third embodiment, the liquid passing member 22 is preferably formed of a woven fabric, a nonwoven fabric, a porous body, or the like having flexibility. The liquid passing member 22 having flexibility can enter the openings 25*a* of the cathode current collector plate 25 to come into close contact with the cathode 23 (for example, the cathode catalyst layer 232), and accordingly is capable of more inhibiting the entrance of the gas component from the cathode 23 to the cathode solution flow path 21. The other structure of the liquid passing member 22 of the electrolytic cell 1C is the same as that of the liquid passing member 22 of the electrolytic cell 1A of the first embodiment.

Fourth Embodiment

Figure 7:
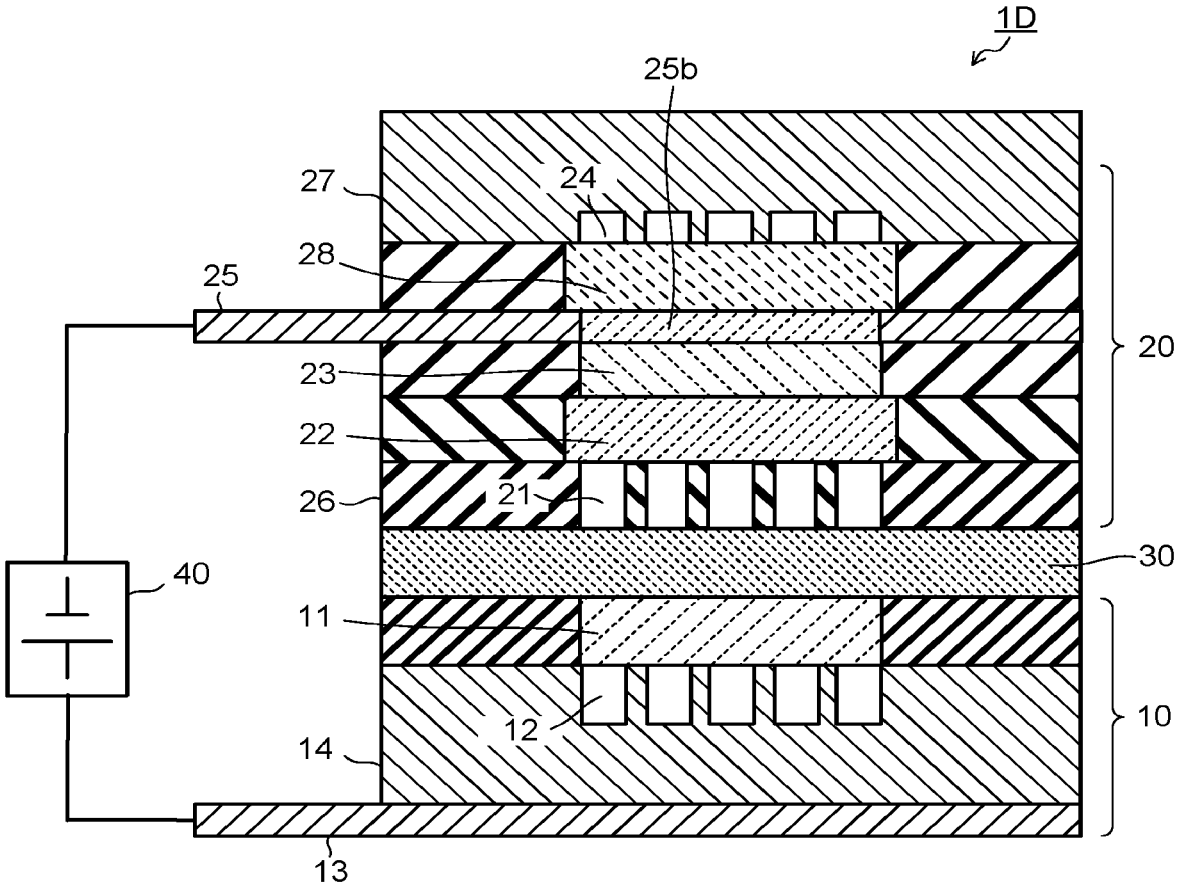
FIG. 7 is a sectional view illustrating an electrolytic cell of a fourth embodiment.

Next, an electrolytic cell 1 for carbon dioxide according to a fourth embodiment will be described with reference to FIG. 7. The electrolytic cell 1D for carbon dioxide illustrated in FIG. 7 includes an anode part 10, a cathode part 20, and a separator 30 as in the second and third embodiments. The structures of the anode part 10, the cathode part 20, the separator 30, and so on and the structure of an electrolytic device using the electrolytic cell 1D are the same as those in the second and third embodiments. In the electrolytic cell 1D illustrated in FIG. 7, the cathode current collector plate 25 is disposed between the cathode 23 and the hydrophobic porous body 28, which is a different point from the electrolytic cells 1B, 1C of the second and third embodiments.

The cathode current collector plate 25 is in contact with the cathode 23 (for example, the gas diffusion layer 231), so that they are in electrical continuity. In order for the cathode current collector plate 25 disposed between the cathode 23 and the hydrophobic porous body 28 not to prevent the $CO_2$ gas flowing in the $CO_2$ gas flow path 24 from coming into contact with the cathode 23, an area 25*b*, in the cathode collector plate 25, in contact with the gas diffusion layer 231 is formed into a shape allowing the passage of the $CO_2$ gas by, for example, meshing, punching, or porosification processing. Alternatively, the area 25*b* in contact with the gas diffusion layer 231 may have openings whose open area ratio is 40% or more. As the cathode collector plate 25, a material low in chemical reactivity and high in conductivity is preferably used. Examples of such a material include metal materials such as Ti and SUS, and carbon.

Disposing the cathode current collector plate 25 between the cathode 23 and the hydrophobic porous body 28 enables the use of an insulator as the hydrophobic porous body 28 as in the third embodiment. This makes it possible to inhibit the lowering of $CO_2$ reduction efficiency while enhancing the hydrophobic function of the hydrophobic porous body 28. In the electrolytic cell 1D of the fourth embodiment, the content of the fluororesin in the hydrophobic porous body 28 can be increased, and the content of the fluororesin in the hydrophobic porous body 28 can be further set to substantially 100 mass %, as in the third embodiment. In the hydrophobic porous body 28, the content of the fluororesin and a specific material are preferably the same as those of the third embodiment. The use of such a hydrophobic porous body 28 enables the more effective prevention of the mixture of the cathode solution into the $CO_2$ gas flow path 24 to enhance the property of the electrolytic cell 1D and its sustainability.

EXAMPLES

Next, examples and their evaluation results will be described.

Example 1

Figure 6:
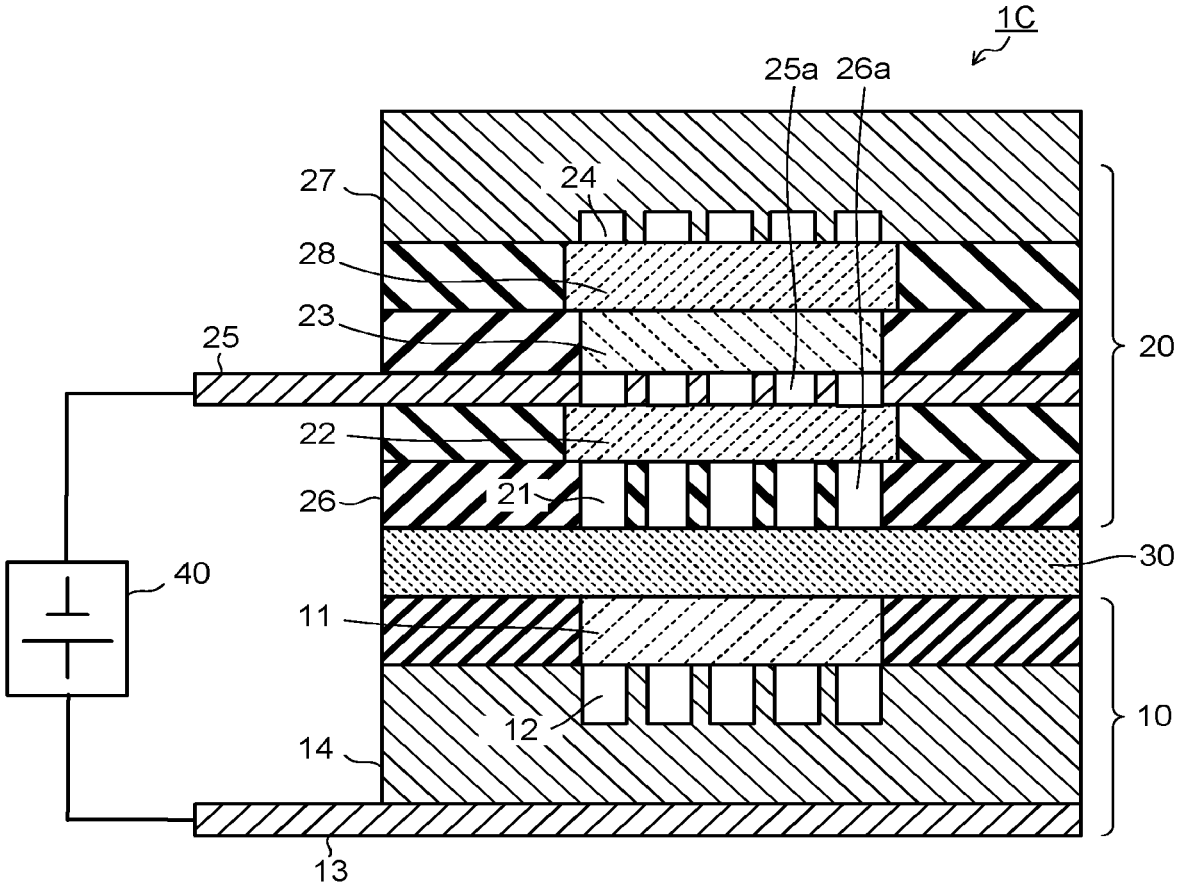
FIG. 6 is a sectional view illustrating an electrolytic cell of a third embodiment.

The electrolytic cell 1C for carbon dioxide whose structure is illustrated in FIG. 6 was assembled and its carbon dioxide electrolytic performance was examined. Specifically, a solution system and a gas system illustrated in FIG. 8 were connected to the electrolytic cell 1C illustrated in FIG. 6 to form an electrolytic device, and the carbon dioxide electrolytic performance was examined. In the electrolytic device illustrated in FIG. 8, a first solution system having a pressure control part 61, an anode solution tank 62, a flow rate control part (pump) 63, and a reference electrode 64 connects with the anode solution flow path 12 so that the anode solution circulates in the anode solution flow path 12.

A second solution system having a pressure control part 65, a solution separating part 66, a cathode solution tank 67, a flow rate control part (pump) 68, and a reference electrode 69 connects with the cathode solution flow path 21 so that the cathode solution circulates in the cathode solution flow path 21. The second solution system has a waste liquid tank 70 provided in a solution route branching from a solution circulation route. The $CO_2$ gas is introduced into the $CO_2$ gas flow path 24 from a $CO_2$ gas cylinder 72 through a flow rate control part 71. The $CO_2$ gas which has flowed in the $CO_2$ gas flow path 24 is sent from the not-illustrated gas outlet port to a gas-liquid separating part 74 through the pressure control part 73, and is further sent to a product collecting part 75. The product collecting part 75 is provided with an electrolytic cell performance detecting part 76. The operations of these parts are controlled by a data collection/control part 77.

As the anode 11, an electrode having a Ti mesh coated with $IrO_2$ nanoparticles serving as a catalyst was used. As the anode, a 2×2 cm portion cut out from the $IrO_2$/Ti mesh was used.

As the catalyst layer of the cathode 23, a coating layer of nanoparticles whose main component was $Cu_2O$ was used. As the gas diffusion layer, carbon paper having MPL (microporous layer) was used. The cathode was fabricated by the following procedure. First, a reducing agent is introduced into an aqueous copper acetate solution, whereby the nanoparticles whose main component was $Cu_2O$ was prepared. A coating solution was prepared in which the $Cu_2O$ nanoparticles, tetrahydrofuran, and IPA (isopropyl alcohol) were mixed. This coating solution was filled in a spray and spray-coated the carbon paper having MPL, using an Ar gas. A temperature during the coating was set to 80° C. After the coating, the resultant was washed with running pure water for ten minutes. After drying, from the resultant, a 2×2 cm portion was cut out as the cathode (electrode area D=4 $cm^2$).

To form the electrolytic cell 1C, the $CO_2$ gas flow path 24 (the third flow path plate 27), the hydrophobic porous body 28, the cathode 23, the cathode current collector plate 25, the liquid passing member 22, the cathode solution flow path 21 (the second flow path plate 26), the separator 30, the anode 11, the anode solution flow path 12 (the first flow path plate 14), and the anode current collector plate 13 were stacked in the mentioned order from the top as illustrated in FIG. 6, and the resultant was sandwiched by not-illustrated support plates and was further fastened with bolts. As the liquid passing member 22, a zirconia cloth (brand name: ZYK-15, manufactured by Zircar Ceramics, Inc.) with a thickness of 300 μm and a porosity of 85% was used. As the hydrophobic porous body 28, a PTFE porous sheet with a thickness of 80 μm and a porosity of 60 to 80% was used. As the separator 30, a cation exchange membrane (brand name: Nafion 117, manufactured by DuPont) was used. The $IrO_2$/Ti mesh as the anode 11 was brought into close contact with the anion exchange membrane. The cathode solution flow path 21 had a thickness of 1 mm. In the stacking, the longitudinal direction of the lands of the cathode solution flow path 21 and the longitudinal direction of the lands of the $CO_2$ gas flow path 24 and the anode solution flow path 12 were set parallel to each other. Note that an evaluation temperature was set to a room temperature.

Figure 8:
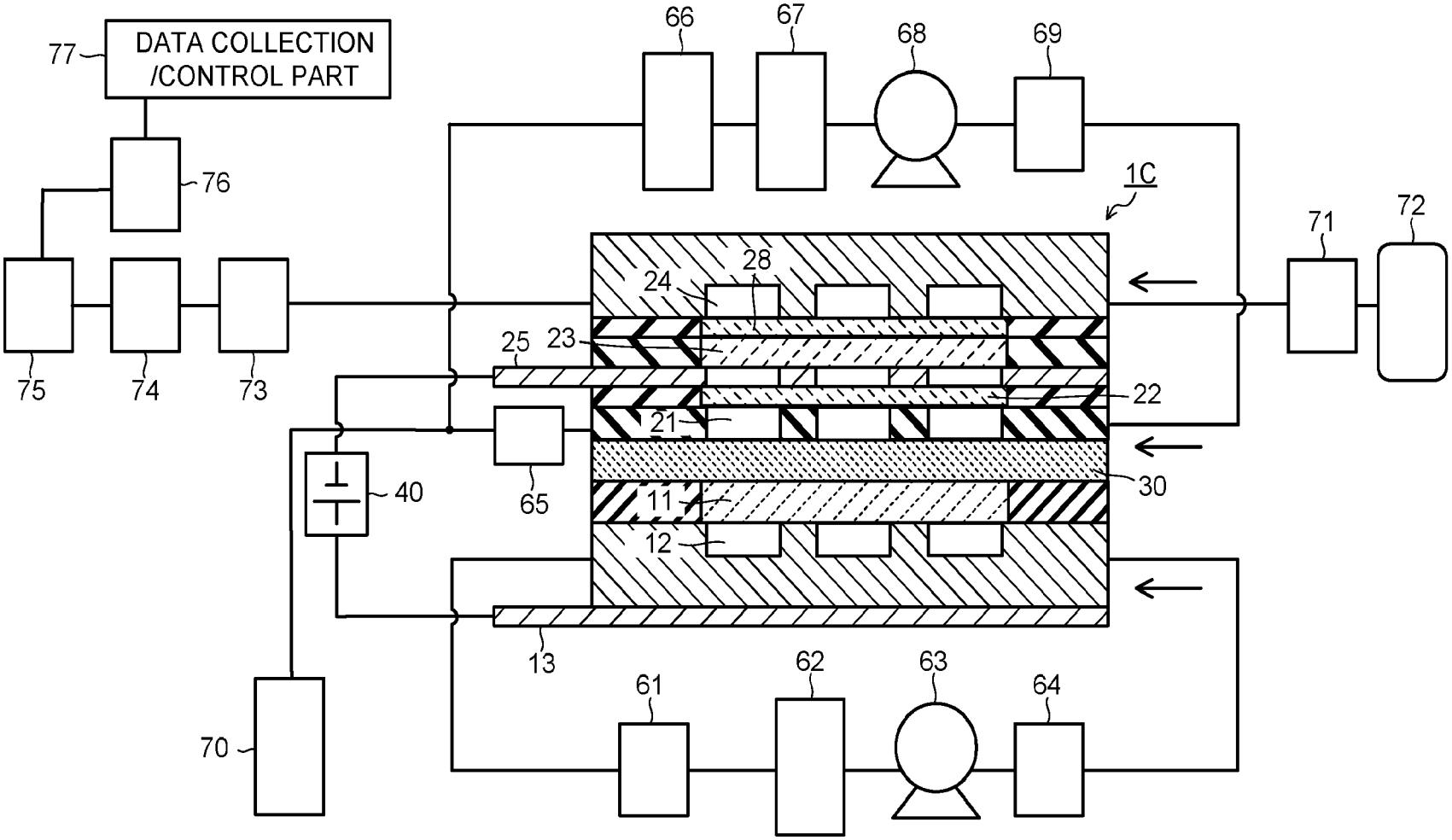
FIG. 8 is a view illustrating the structure of an electrolytic device for carbon dioxide of an example.

The electrolytic device illustrated in FIG. 8 was run under the following condition. A $CO_2$ gas was supplied to the $CO_2$ gas flow path at 25 sccm, while an aqueous potassium chloride solution (concentration 1M KOH) was made to flow in the cathode solution flow path at a 2 mL/minute flow rate and an aqueous potassium hydroxide solution (concentration 1M KOH) was made to flow in the anode solution flow path at a 20 mL/minute flow rate. Next, using an electrochemical measurement system (manufactured by Bio-Logic) as the power source, a constant current was passed across the anode and the cathode for seventy minutes to cause a reduction reaction of $CO_2$, and a cell voltage during this period was collected. Further, a gas output from the $CO_2$ gas flow path was partly collected, and a production amount of a carbon compound or a $H_2$ gas produced through the $CO_2$ reduction reaction or the water reduction reaction was analyzed with a gas chromatograph.

From the gas concentration, an ethylene production amount and a partial current $I_{C2H4}$ [A] used for the ethylene production were calculated, and Faradaic efficiency $FE_{C2H4}$ [%] of the ethylene was calculated using the following formula.

$$I_{C2H4}=M_{C2H4}\times F\times z$$

$$FE_{C2H4}=I_{C2H4}/I_{total}$$

$M_{C2H4}$ is the ethylene production amount [mol $s^{-1}$], F is a Faraday constant [C mol $s^{-1}$], and z is the number of reaction electrons, which is 12 in ethylene, and $I_{total}$ is the total current and is 0.8 [A]since the electrode area is 4 $cm^2$. Incidentally, as the cathode solution, the 16 mL aqueous potassium chloride solution was circulated, and the concentration [mM] of ethanol contained in the aqueous potassium chloride solution 70 minutes later was analyzed by NMR.

Figure 9:
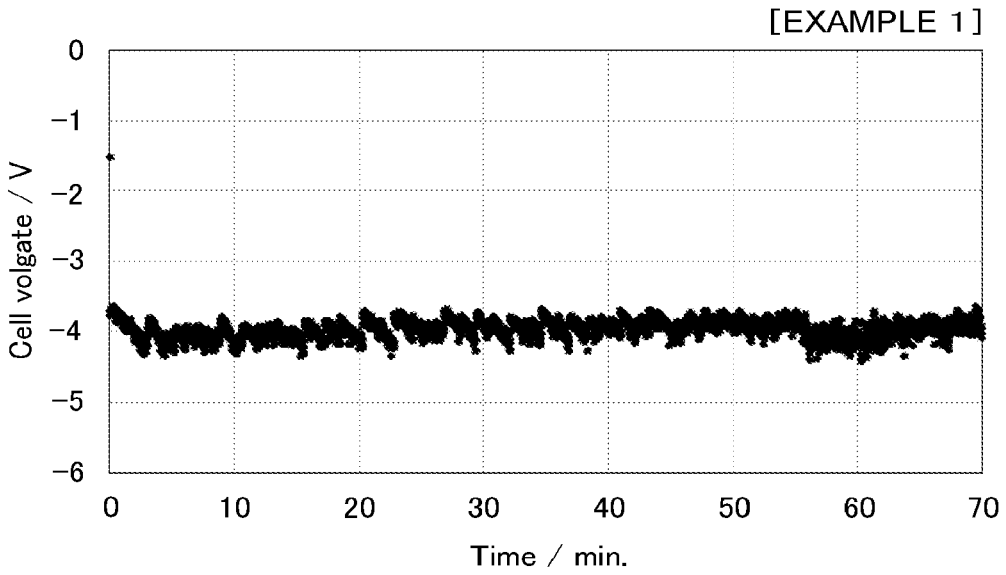
FIG. 9 is a chart illustrating a temporal change in a cell voltage in the electrolytic device for carbon dioxide of the example 1.
Figure 10:
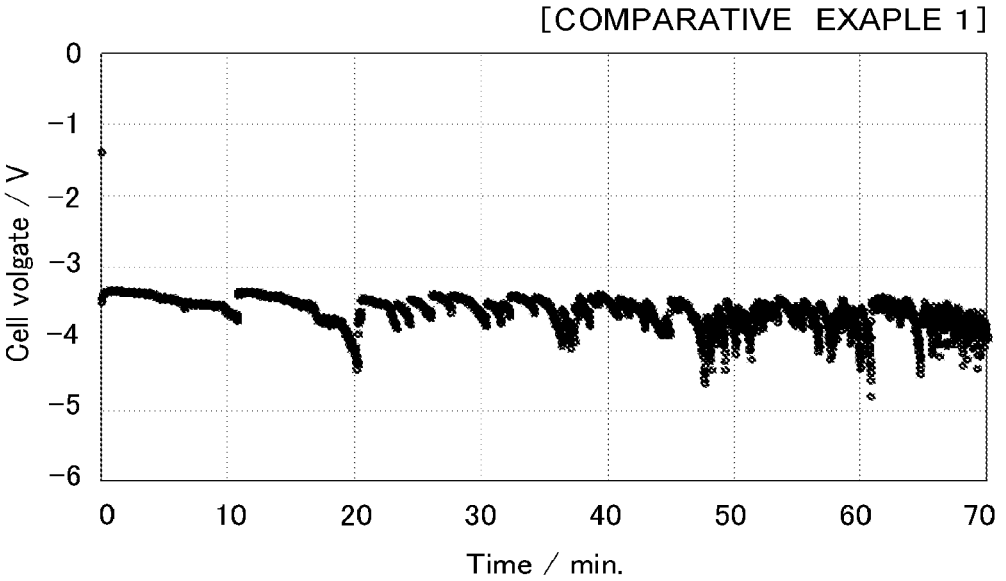
FIG. 10 is a chart illustrating a temporal change in a cell voltage in an electrolytic device for carbon dioxide of a comparative example 1.

FIG. 9 and FIG. 10 illustrate the results of examinations on a temporal change in the cell voltage when the constant current (−0.8 A/−0.2 A $cm^{-2}$) was passed to the anode solution for seventy minutes. Here, the cell voltage is a cathode-anode potential difference, and has a minus value since it is based on the anode. FIG. 9 illustrates the measurement result of the electrolytic device according to the example 1, and FIG. 10 illustrates the measurement result of an electrolytic device as a comparative example 1 using an electrolytic cell fabricated in the same manner as the example 1 except that the liquid passing member (zirconia cloth) is not disposed. In FIG. 9 and FIG. 10, a fluctuation including increases and decreases in the cell voltage is occurring with time. Since the solution resistance increases due to the entrance of the gas from the cathode to the cathode solution flow path, the cell voltage increases, but since the voltage decreases due to the discharge of the gas along with the discharge of the cathode solution, such a fluctuation occurs.

Figure 11:
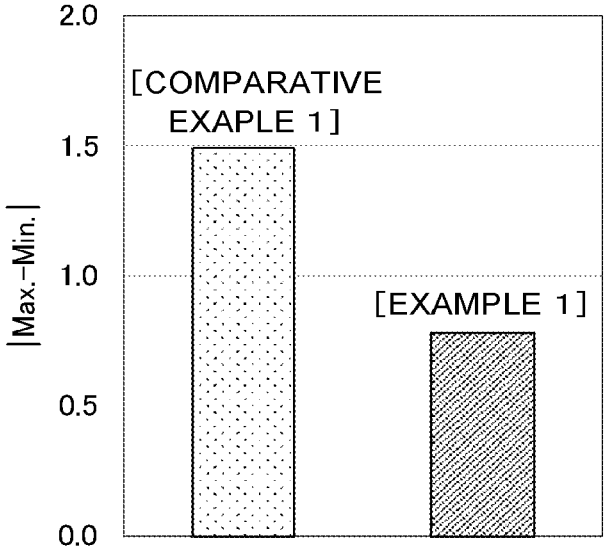
FIG. 11 is a chart illustrating fluctuation widths of the cell voltage in the electrolytic devices for carbon dioxide of the example 1 and the comparative example 1.

As illustrated in FIG. 10, the fluctuation in the cell voltage increases with time in the electrolytic cell of the comparative example 1 not using the liquid passing member (zirconia cloth), but as illustrated in FIG. 9, it is seen that a fluctuation width of the cell voltage and the cell voltage fluctuation with time are small in the electrolytic cell of the example 1. FIG. 11 illustrates the fluctuation widths (absolute values of differences between the maximum values and the minimum values) of the cell voltages during seventy minutes. It is seen from FIG. 11 that, as compared with the case where the liquid passing member (zirconia cloth) is not disposed (the comparative example 1), the fluctuation width of the cell voltage is smaller in the case where the zirconia cloth is disposed (the example 1). A possible reason why the fluctuation width of the cell voltage is smaller may be that the liquid passing member (zirconia cloth) reduces the entrance of the gas component to the cathode solution flow path.

Figure 12:
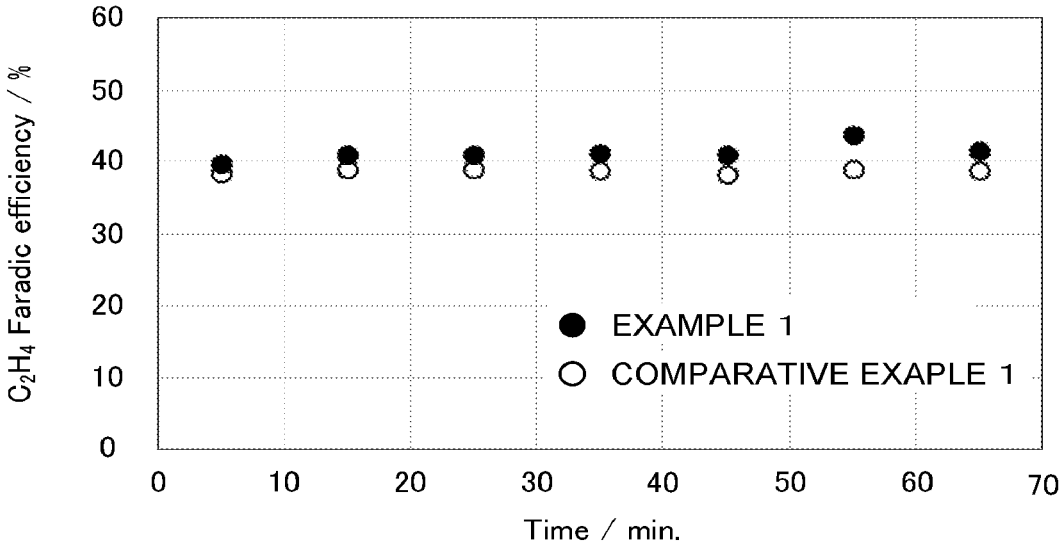
FIG. 12 is a chart illustrating temporal changes in Faradaic efficiency of ethylene in the electrolytic devices for carbon dioxide of the example 1 and the comparative example 1.
Figure 13:
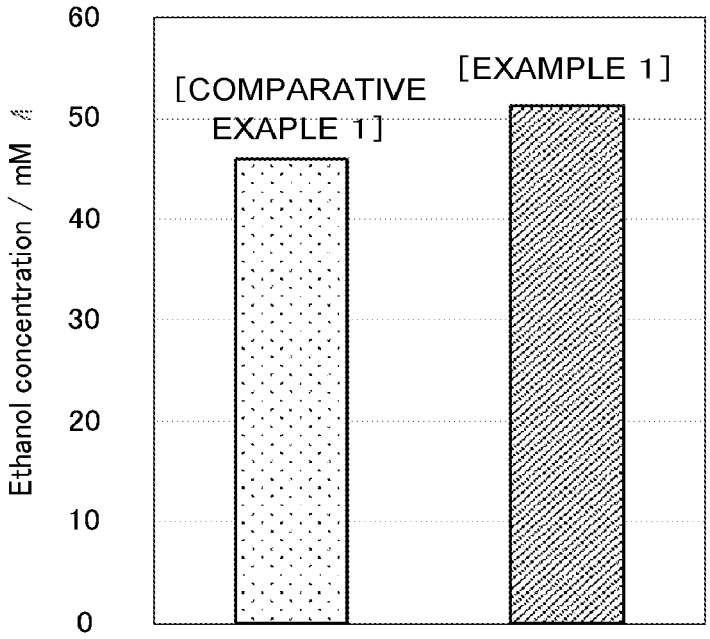
FIG. 13 is a chart illustrating the ethanol concentrations in a cathode solution in the electrolytic devices for carbon dioxide of the example 1 and the comparative example 1.

FIG. 12 illustrates temporal changes in the Faradaic efficiency of the ethylene. As illustrated in FIG. 12, irrespective of the presence/absence of the liquid passing member (zirconia cloth), the Faradaic efficiency of the ethylene is about the same, which shows that the $CO_2$ reduction reaction progresses stably during sixty minutes. Further, FIG. 13 illustrates the concentrations of the ethanol contained in the aqueous potassium chloride solution measured seventy minutes later. As illustrated in FIG. 13, irrespective of the presence/absence of the liquid passing member (zirconia cloth), the concentration of the ethanol is about the same, which shows that the ethanol can be taken out from the cathode solution flow path through the liquid passing member (zirconia cloth).

It should be noted that the structures of the above-described embodiments may be employed in combination, or part thereof may be modified. While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An electrolytic cell for carbon dioxide comprising:

an anode part including an anode to oxidize water or a hydroxide ion and thus produce oxygen and an anode solution flow path to supply an anode solution to the anode;

a cathode part including a cathode to reduce carbon dioxide and thus produce a carbon compound, a cathode solution flow path having a solution inlet port and a solution outlet port to supply a cathode solution to the cathode, a gas flow path having a gas inlet port and a gas outlet port to supply the carbon dioxide to the cathode, and a liquid passing member disposed between the cathode and the cathode solution flow path and having a pore allowing the cathode solution to pass through while holding the cathode solution; and a separator to separate the anode part and the cathode part from each other, wherein the liquid passing member has a porosity of not less than 40% and not more than 90%.

2. The cell according to claim 1, wherein the liquid passing member includes a woven fabric, a nonwoven fabric, or a porous body allowing a liquid and an ion to pass through.

3. The cell according to claim 1, wherein the liquid passing member includes a woven fabric or a nonwoven fabric of a zirconia fiber.

4. The cell according to claim 1, wherein the liquid passing member includes a woven fabric, nonwoven fabric, or a porous body containing a fluororesin undergone a hydrophilic treatment.

5. The cell according to claim 1, herein the separator includes an ion exchange membrane, and the ion exchange membrane is a cation exchange membrane.

6. The cell according to claim 1, wherein the cathode solution contains a halide ion.

7. The cell according to claim 1, wherein the cathode solution contains at least one selected from the group consisting of a hydrogen carbonate ion and a carbonate ion.

8. The cell according to claim 1, wherein the cathode part includes a hydrophobic porous body disposed between the cathode and the gas flow path.

9. The cell according to claim 1, wherein the anode part includes an anode current collector plate in electrical connection with the anode, and the cathode part includes cathode current collector plate in electrical connection with the cathode.

10. The cell according to claim 9, wherein the cathode current collector plate is disposed between the cathode solution flow path and the liquid passing member, and has an opening with a 40% open area ratio or more.

11. An electrolytic device for carbon dioxide comprising:

the electrolytic cell according to claim 1; and a power source to pass a current across the anode and the cathode of the electrolytic cell.

12. The cell according to claim 1, wherein the liquid passing member has a porosity of not less than 80% and not more than 90%.

* * * * *